US011739545B2

(12) United States Patent
Squillacioti

(10) Patent No.: US 11,739,545 B2
(45) Date of Patent: Aug. 29, 2023

(54) FORMWORK SYSTEM AND METHOD

(71) Applicant: Adrian Squillacioti, Galston (AU)

(72) Inventor: Adrian Squillacioti, Galston (AU)

( * ) Notice: Subject to any disclaimer, the term of this patent is extended or adjusted under 35 U.S.C. 154(b) by 682 days.

(21) Appl. No.: 16/606,308

(22) PCT Filed: Apr. 20, 2018

(86) PCT No.: PCT/AU2018/050359
§ 371 (c)(1),
(2) Date: Oct. 18, 2019

(87) PCT Pub. No.: WO2018/191788
PCT Pub. Date: Oct. 25, 2018

(65) Prior Publication Data

US 2021/0404194 A1 Dec. 30, 2021

(30) Foreign Application Priority Data

Apr. 20, 2017 (AU) ..... 2017901447

(51) Int. Cl.
*E04G 13/06* (2006.01)
*E04G 17/14* (2006.01)
*E04B 5/32* (2006.01)
*E04G 11/36* (2006.01)

(52) U.S. Cl.
CPC ..... *E04G 13/06* (2013.01); *E04B 5/32* (2013.01); *E04G 11/365* (2013.01); *E04G 17/14* (2013.01)

(58) Field of Classification Search
CPC ..... E04G 11/365; E04G 17/12; E04G 17/14; E04G 13/06; E04G 13/062; E04B 5/32
USPC ..... 249/8, 34, 208
See application file for complete search history.

(56) References Cited

U.S. PATENT DOCUMENTS 5,343,667 A 9/1994 Peden
9,783,982 B2 * 10/2017 Dinmore ..... E04B 5/32
2015/0159386 A1 6/2015 Dinmore et al.

FOREIGN PATENT DOCUMENTS

AU 61999/94 A 11/1994
AU 2003200942 A1 10/2003
AU 2008202741 A1 1/2009
CN 104695698 A 6/2015
(Continued)

OTHER PUBLICATIONS

International Search Report and Written Opinion dated May 9, 2018 by the International Searching Authority for International Application No. PCT/AU2018/050359, filed on Apr. 20, 2018 and published as WO/2018/191788 on Oct. 25, 2018 (Applicant—Adrian Squillacioti) (10 Pages).

(Continued)

*Primary Examiner* — Michael Safavi
(74) *Attorney, Agent, or Firm* — BALLARD SPAHR LLP

(57) ABSTRACT

A formwork system (100) includes a rebate board (105) having a generally L shaped profile in end view, the rebate board (105) having a first arm (110) and a second arm (120), the first and second arms (120) being angled at about 90 degrees relative to each other, the second arm (120) being securable to an upper portion of a formwork bottom board (200). The system (100) includes a brace (400) having a first engagement formation (410) configured to engage with the first arm (110), and a second engagement formation (435) configured to engage with a peg (220) or other fixed member.

16 Claims, 6 Drawing Sheets

(56) References Cited

FOREIGN PATENT DOCUMENTS

| | | | |
|---|---|---|---|
| DE | 202004010803 | U1 | 9/2004 |
| GB | 1507304 | A | 4/1978 |
| WO | WO-2005/014955 | A1 | 2/2005 |
| WO | WO-2018/191788 | A1 | 10/2018 |

OTHER PUBLICATIONS

International Preliminary Report on Patentability dated Aug. 22, 2019 by the International Searching Authority for International Application No. PCT/AU2018/050359, filed on Apr. 20, 2018 and published as WO/2018/191788 on Oct. 25, 2018 (Applicant—Adrian Squillacioti) (21 Pages).

* cited by examiner

FORMWORK SYSTEM AND METHOD

CROSS-REFERENCE TO RELATED APPLICATIONS

This application is a national stage filing under 35 U.S.C. § 371 of International Application No. PCT/AU2018/050359, filed on Apr. 20, 2018, which claims benefit of Australian patent application No. 2017901447, filed Apr. 20, 2017, which are herein incorporated by reference in their entireties.

TECHNICAL FIELD

The present disclosure relates to a formwork system and method. In particular, the present invention relates to a formwork system and method for use during the construction of ground floor concrete slabs in residential and commercial applications.

BACKGROUND OF THE INVENTION

A traditional slab on ground is generally constructed by one of two methods, namely a raft slab; or alternatively a waffle pod slab. Each of these methods presents advantages and disadvantages. Despite the variations, each completed slab is similar in that they are both formed up with an edge beam and a rebated toe which provides a bearing surface for the brick work (or other wall material) of the external walls of the house is to sit on. The edge beam typically has a height of 170 mm to 240 mm, but in some instances can be as high as 1500 mm or more. The rebate toe generally has a height and width of 150 mm.

The existing method for forming a rebated toe on either type of slab requires timber bottom boards, typically 150 mm high, which are held in position by timber pegs, evenly spaced at approximately 900 mm intervals. The top of the bottom board defines the height of the rebated surface that the external layer of brickwork is to be seated on.

The subsequent step in the process is to place metal rebate clamps onto the bottom board timbers, which are nailed in position at approximately 900 mm intervals. The purpose of the rebate clamps is to provide a structure to hang the top boards and to prevent the top boards from moving when the concrete is poured.

Once the metal rebate clamps are in position, the top boards (generally 250 mm high) are hung on the rebate clamps and nailed into position, which defines a void between the top of the bottom board and the bottom of the top board which allows access to the top of the rebate toe so that the concrete can be levelled off when the slab is poured.

Top braces, which are generally timber, are then nailed from the top of the top boards to the timber pegs to provide additional support to prevent the top boards from moving when the concrete is poured.

Whilst the existing formwork system for constructing rebate toes as outlined above is widely used, it suffers from several inherent drawbacks. In particular, timber boards are heavy and they tend to become heavier when wet due to the timber absorbing water.

A further drawback is that timber boards are nailed together during assembly of the formwork. As such, the timber boards require a large amount of effort to disassemble and de-nail. The nails are then discarded and not re-used.

A further drawback is that the rebate clamps are fabricated from metal which means that they are heavy and put a lot of weight on bottom boards. Furthermore, concrete tends to stick to the rebate clamps, which make them heavier and difficult to clean.

Another problem is that the rebate clamps leave a void from the bottom board to top board. When the slab is poured, the concrete is normally vibrated which results in concrete coming up through the void over the top of the bottom board. Surplus concrete is then scraped level with the top of the bottom boards and dumped on the ground and wasted at the cost of the concreter or builder.

The top braces that are normally used are thin pieces of timber, they splinter and break easily during use and do not have a long life. They are then thrown away on site at the builder's cost for disposal.

When timber boards are cut down to desired lengths during use, they eventually become too short to reuse. Such timber boards are also thrown out on site at the builder's cost. Further drawbacks associated with using timber boards include that they are environmentally unfriendly. In addition, timber boards are heavy, and accordingly, they tend to cause a lot of wear on concreting trucks during transportation to and from sites.

In addition to the aforementioned drawbacks associated with using heavy timber boards, the weight is known to pose problems with respect to operational health and safety (OHS) on account of heavy lifting issues, and a significant risk of injury.

OBJECT OF THE INVENTION

It is an object of the present invention to substantially overcome or at least ameliorate one or more of the above disadvantages, or to provide a useful alternative.

SUMMARY OF THE INVENTION

In a first aspect, the present invention provides a temporary formwork system for forming concrete slabs comprising:

a rebate board having a generally L shaped profile in end view, the rebate board having a first arm and a second arm, the first and second arms being angled at about 90 degrees relative to each other, the second arm being securable to an upper portion of a formwork bottom board; and a brace having a first engagement formation configured to engage with the first arm, and a second engagement formation configured to engage with a peg or other fixed member, wherein a generally horizontal underside surface of the second arm and a contiguous generally vertical surface of the first arm are configured to retain setting concrete to define a rebate in the concrete slab.

The first engagement formation preferably includes two longitudinally extending ribs defining a channel configured to abut against and engage opposing sides of the first arm.

The second engagement formation preferably includes a plurality of holes separated from each other along a longitudinal axis of the brace.

The second arm preferably includes a longitudinally extending stopper configured to abut against a bottom board.

The stopper preferably has a triangular cross sectional profile having a flat surface adapted to abut against the bottom board.

The second arm preferably includes a plurality of longitudinally separated air and/or inspection holes.

Each rebate board preferably includes a third engagement formation located at one end of the rebate board and a corresponding fourth engagement formation located at an opposing end of the rebate board, the third and fourth engagement formations permitting like rebate boards to be connected end to end.

The third and fourth engagement formations preferably include male and/or female elements located on each end of the first and second arms of the rebate board.

The second arm preferably includes a male formation at a first end and a corresponding female formation at an opposing second end, further where the first arm includes a first hook portion at the first end and a corresponding second hook portion at the second end.

The first arm preferably includes a male formation at a first end and a corresponding female formation at an opposing second end, further where the second arm includes a first hook portion at the first end and a corresponding second hook portion at the second end.

The formwork system of any one of the preceding claims, further comprising a H-connector having a generally H-shaped cross-sectional profile, the H-connector defining two channels each channel configured to receive a longitudinal edge portion of the bottom board, or the first arm.

The formwork system of claim 11, wherein the H-connector includes a lug having one or more securement holes for engaging with a support member.

The formwork system of any one of the preceding claims, wherein the brace is fabricated in a two part arrangement having a stem which is separable relative to a head.

The formwork system of claim 13, wherein the stem includes a trapezoidal projection adapted to be received by a trapezoidal slot formed in the head.

The formwork system of any one of the preceding claims, wherein the rebate board and the brace are fabricated from a polymer.

The formwork system of any one of the preceding claims, wherein the brace includes upper and lower longitudinally extending stiffening ribs.

In a second aspect, the present invention provides a method of setting up formwork to produce an edge rebate in a concrete slab, the method including the following steps:

securing at least one peg relative to a ground surface;

securing at least one bottom board to the peg such that an upper edge of the bottom board is located at an intended horizontal position of the desired slab rebate;

securing a longitudinally extending rebate board to the bottom board, the rebate board having a generally L shaped profile in end view, the rebate board having a first arm and a second arm, the first and second arms being angled at about 90 degrees relative to each other, the first arm being securable to the bottom board; and securing a first engagement formation of a brace to an upper portion of said second arm and securing a second engagement formation of said brace to said peg to support the rebate board in a position with one arm extending generally vertically and one arm extending generally horizontally.

The step of securing the rebate board to the bottom board preferably includes abutting a longitudinally extending stopper formed on an underside of the first arm against the bottom board, the stopper having a triangular cross sectional profile defining a flat surface adapted to abut against the bottom board.

BRIEF DESCRIPTION OF THE DRAWINGS

A preferred embodiment of the invention will now be described by way of specific example with reference to the accompanying drawings, in which.

DETAILED DESCRIPTION OF THE PREFERRED EMBODIMENTS

Figure 3:
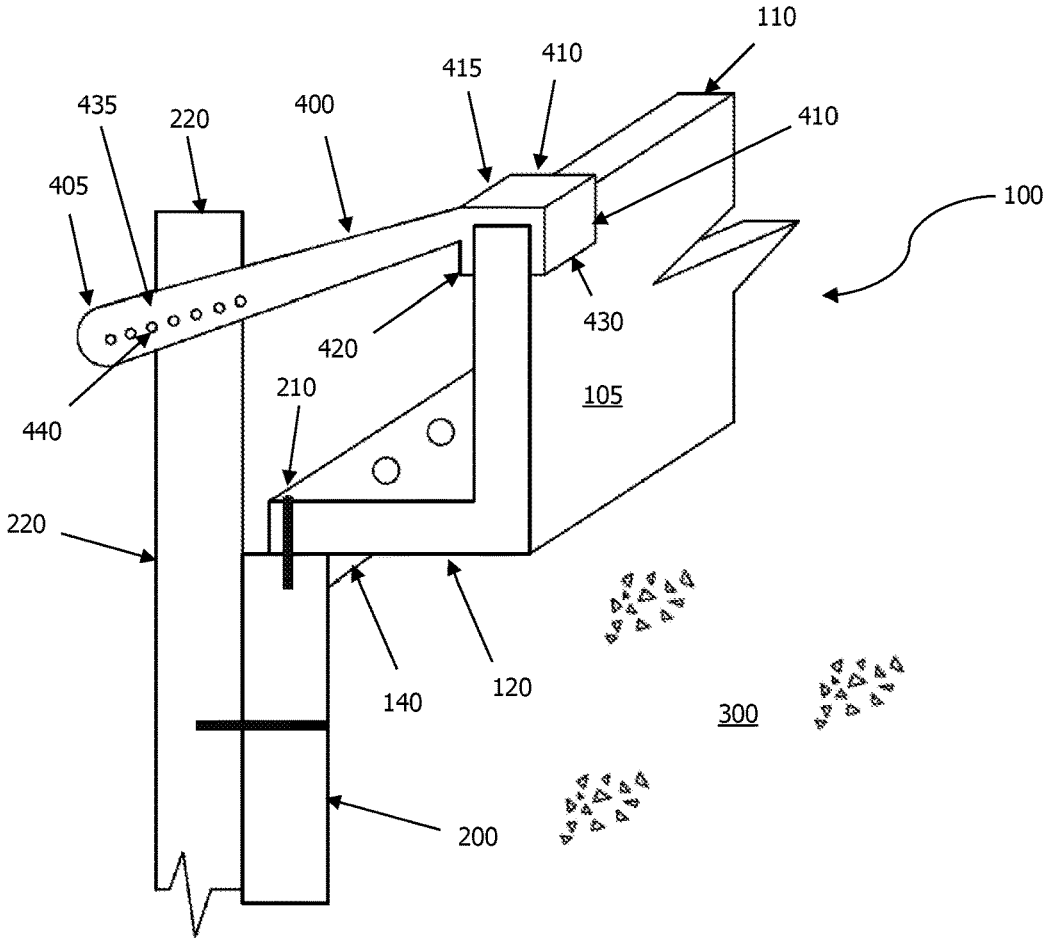
FIG. 3 depicts the formwork system and method of the present invention including the rebate board of FIG. 2.

A formwork system and method 100 is disclosed herein, and best shown in FIG. 3.

The formwork system 100 includes four distinct components that are preferably fabricated from a lightweight plastic, and preferably a recyclable plastic or other such polymer. However, it will be appreciated that timber or composite timber could be used. The formwork system 100 include the following components, which will be discussed in detail below:

a rebate board 105;

a bottom board 200;

a top brace 400, 600, 700; and a H-clip 500

Figure 1:
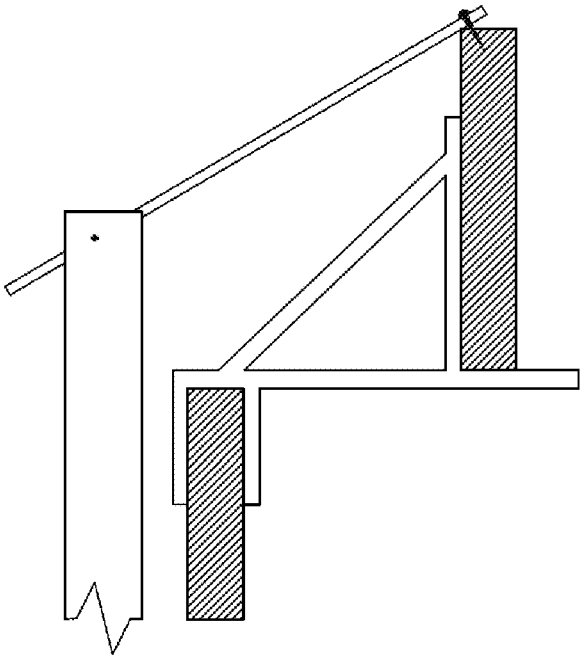
Fig. 1 (Prior art)
FIG. 1 depicts a conventional formwork system for setting out a rebate toe in a ground floor slab.
Figure 2:
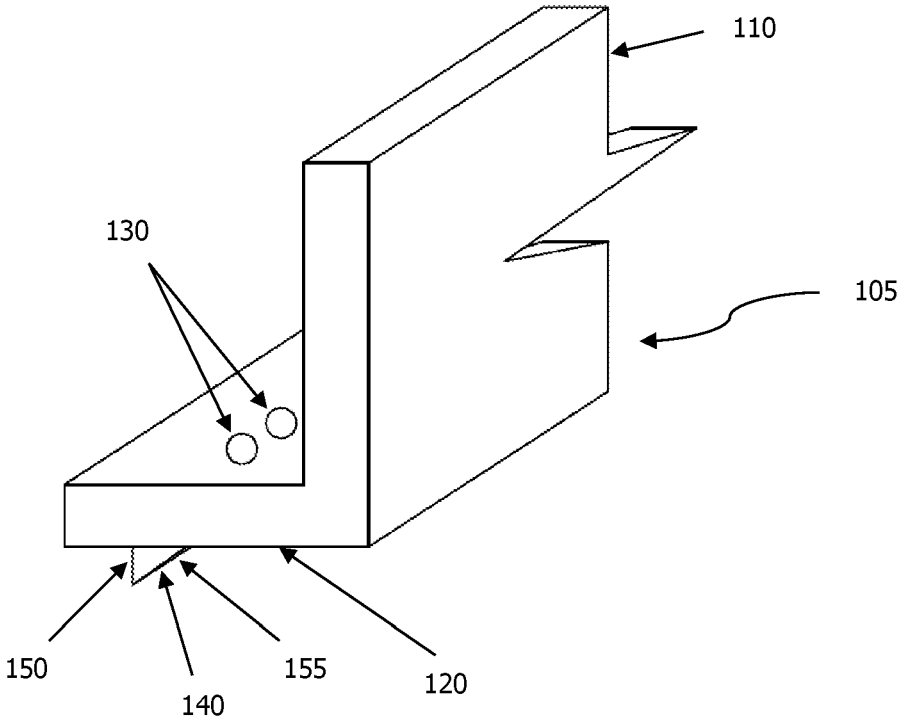
FIG. 2 is a perspective view depicting a portion of a rebate board of the formwork system and method according the present invention.

Referring to FIG. 2, a perspective view of the rebate board 105 of the formwork system and method 100 is shown. The rebate board 105 is preferably fabricated of plastic or another suitable lightweight polymer, such as a recycled plastic.

The rebate board 105 has a generally L shaped profile in end view, and includes first and second arms 110, 120 defining an elbow, such that the two arms 110, 120 are angled at about 90 degrees relative to each other. The horizontal arm 120 includes a plurality of holes 130. The holes 130 act as air egression holes 130 as will be described below. The holes 130 are longitudinally spaced along the length of the rebate board 100.

The underside of the second arm 120 which is horizontal in use includes a longitudinally extending stopper 140. In the embodiment shown in the drawings, the stopper 140 is in the form of projection having a triangular cross-section. A first face 150 of the triangular stopper 140 is generally parallel with the horizontal arm 120. A second face 155 of the triangular stopper 140 is inclined at an angle of approximately 45 degrees relative to the horizontal arm 120, although other angles may be possible.

FIG. 3 depicts the formwork system and method 100 in use. In this arrangement, the rebate board 105 is secured to a bottom board 200 with screws 210, or other suitable fasteners. In this configuration, the first face 150 of the triangular projection 140 abuts against the bottom board 200. This serves two purposes. Firstly, it provides an abutment surface to ensure the vertical arm 110 is uniformly positioned relative to the bottom board 200 around the perimeter of the slab 300. Secondly, it acts as a mould to define a bevelled edge along the perimeter of the concrete slab 300. Advantageously, this reduces the risk of the corner of the slab 300 being damaged when the formwork is removed, and also reduces the risk of the corner of the slab 300 being damaged during the period that the concrete is curing.

Again referring to FIG. 3, the bottom board 200 may be fabricated from a polymer, or a traditional timber or composite timber bottom board 200 may be used. Pegs 220 are located intermittently around the perimeter of the slab. The pegs 220 may be timber or steel, and are typically driven into the ground by force. A peg 220 is shown schematically in FIG. 3. The pegs 220 are typically spaced at approximately 900 mm intervals. The plastic bottom boards 200 are screwed to height against the pegs 220.

As depicted in FIG. 3, the formwork system and method 100 includes a brace 400 having a proximal end 405 and a distal end 415. The distal end 415 of the brace 400 includes a first engagement formation 410 adapted to engage with the upper, vertically extending arm 110 of the rebate board 105. In one embodiment, the first engagement formation 410 is provided by two longitudinally extending ribs 420, 430, which define a channel that is adapted to abut against and engage opposing sides of the vertical arm 110.

Figure 5:
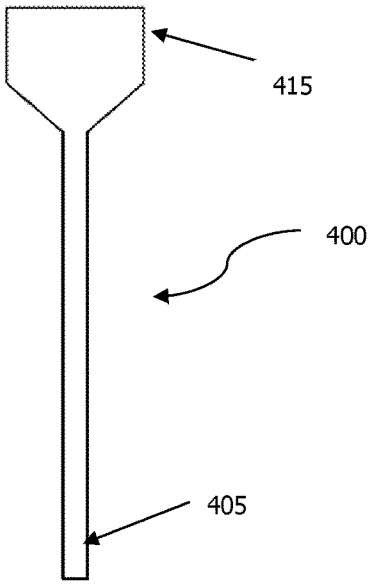
FIG. 5 is a top view of a top brace of the of the formwork system and method according to FIG. 3.

The proximal end 405 of the brace 400 includes a second engagement formation 435 adapted to engage with the peg 220 or another suitable structural element. In a preferred embodiment, the second engagement formation 435 is defined by a series of longitudinally spaced holes 440. The holes 440 enable the brace 400 to be screwed or nailed to the peg 220. The spacing between the holes 440 enables the concreter to select the hole 440 that is most suitable depending on the position of the peg 220, providing a degree of adjustability to suit site specific conditions. The brace 400 is shown in top view in FIG. 5.

Figure 11:
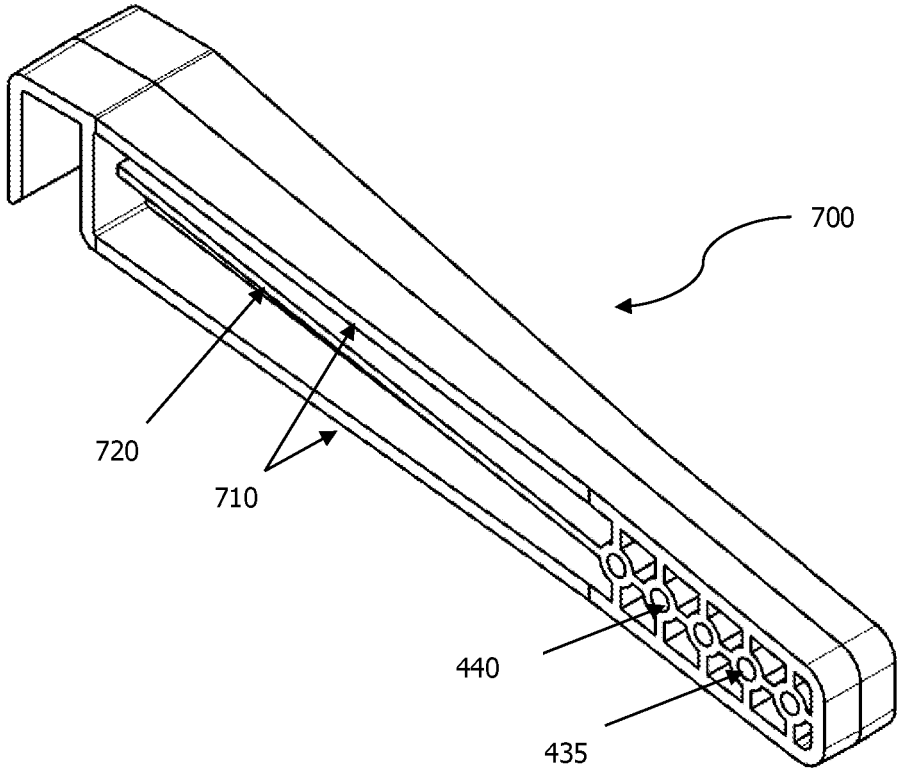
FIG. 11 is a top perspective view of a brace according to an embodiment of the formwork system and method.
Figure 12:
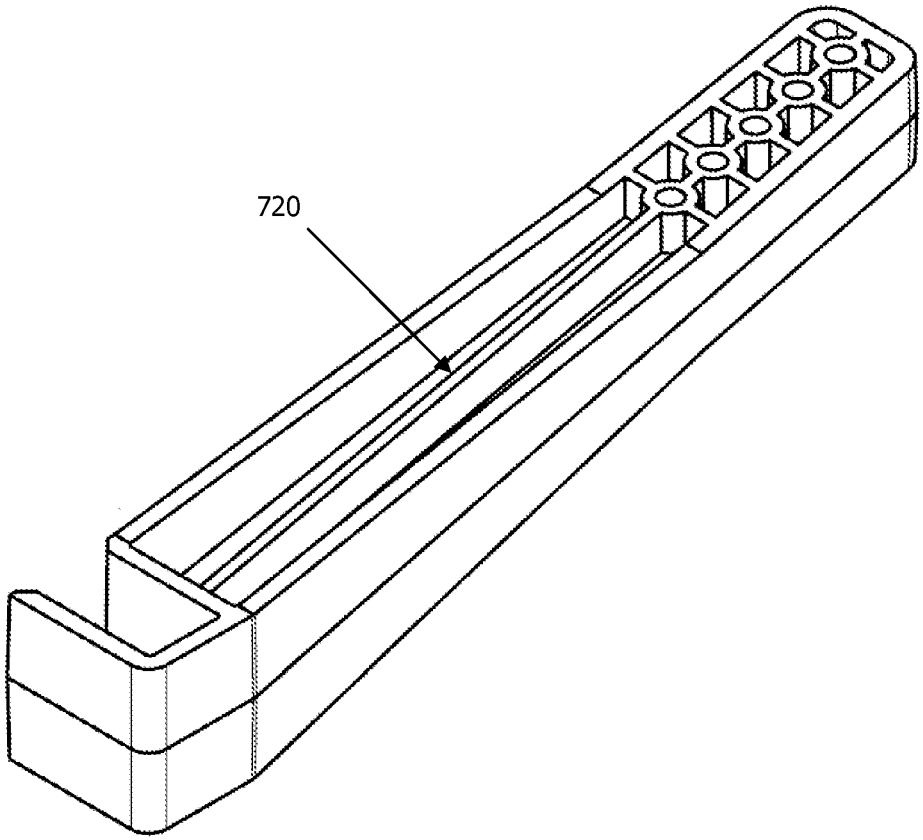
FIG. 12 is a side perspective view of the brace according to FIG. 11.

FIGS. 11 and 12 depict a brace 700 according to a second embodiment. The brace 700 is operationally the same as the aforementioned brace. However, the brace 700 is constructed having upper and lower flanges 710 which provide improved stiffening. In addition, the brace 700 includes longitudinally extending stiffening ribs 720 on each side which also increase stiffness. Due to the action of the flanges 710 and the stiffening ribs 720, the brace 700 has increased ability to withstand loads such as compressive or torsional loads which may be encountered during pouring of the concrete and curing of the concrete. Advantageously, the use of the flanges 710 and the stiffening ribs 720 provides desirable strength characteristics at relatively low weight per unit.

Figure 4:
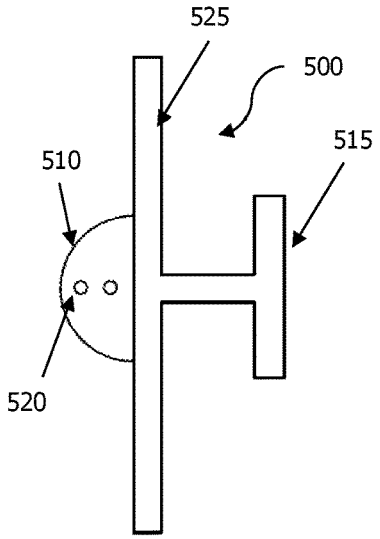
FIG. 4 is an end view of a H-connector of the formwork system and method according to the present invention.

Referring to FIG. 4, the formwork system and method 100 includes H-connectors 500, depicted in end view. The H-connectors 500 can be used to connect bottom boards 200 laterally, in the manner schematically depicted in FIG. 8. The H-connectors 500 can also be used to connect a board 200 to the rebate board 105, also depicted in FIG. 8. This vertical extension above the rebate board 105 allows the concreter to increase the vertical height slab at the rebate toe, which may be desirable in some scenarios.

In the embodiments depicted in the drawings, the H-connector includes one short arm 515 and one long arm 525. However, it will be appreciated that the arms 515, 525 may be provided having even lengths.

Figure 6:
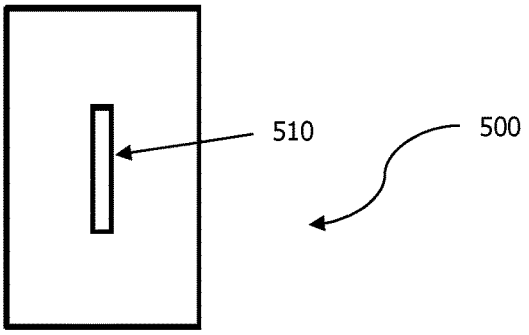
FIG. 6 is a side view of the H-clip of FIG. 4.
Figure 7:
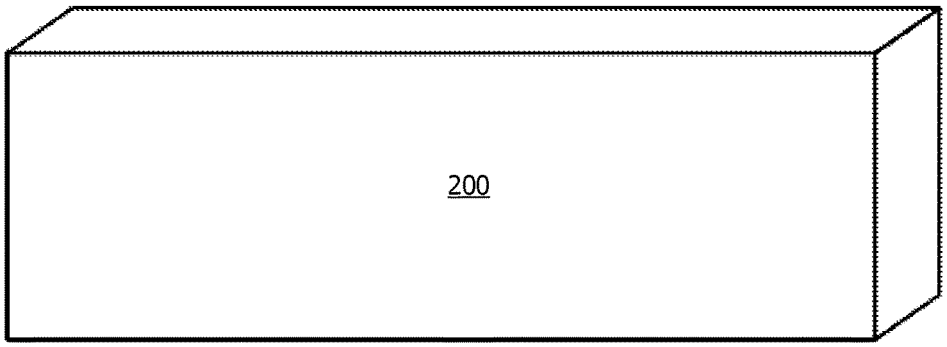
FIG. 7 is a perspective view of a form board of the formwork system and method of FIG. 3.

FIG. 6 shows the H-connector 500 in side view. The H-connector 500 has a lug 510 which has one or more holes 520 formed therein. The holes 520 permit bracing such as a timber post to be secured to the H-connector 500. This is advantageous to ensure adequate formwork rigidity to offset the larger pressures acting on the formwork during a concrete pours having a greater depth.

Figure 9:
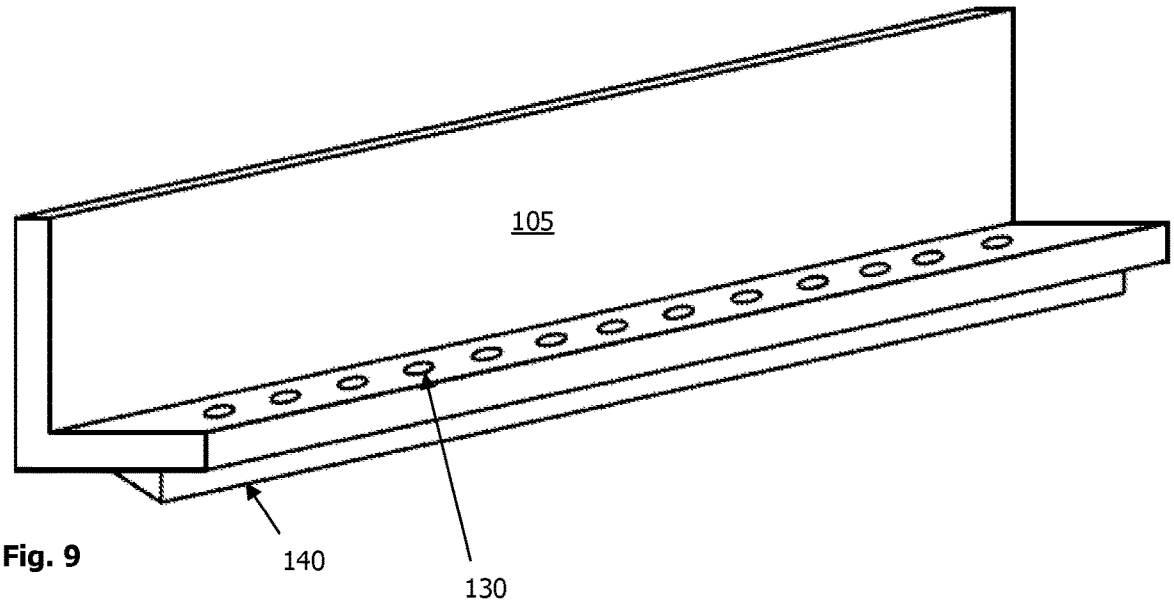
FIG. 9 is a perspective view depicting the rebate board of FIG. 2.

FIG. 9 depicts a single length of the rebate board 105. Typically the rebate boards 105 are manufactured and sold in 5.5 m lengths, however it will be appreciated that other sizes are possible. During the concrete pour, the holes 130 permit air to exit from the form as the concrete level rises, thereby minimising the likelihood of air becoming trapped in the mould. When concrete begins to rise through the holes 130, the concreter is aware that the formwork has been filled to at least the horizontal step of the rebate toe. However, the underside surface of the horizontal arm 120 of the rebate board 105 prevents the concrete from rising further, and minimises the risk of unwanted concrete extending vertically beyond the desired rebate toe horizontal upper surface.

Figure 10:
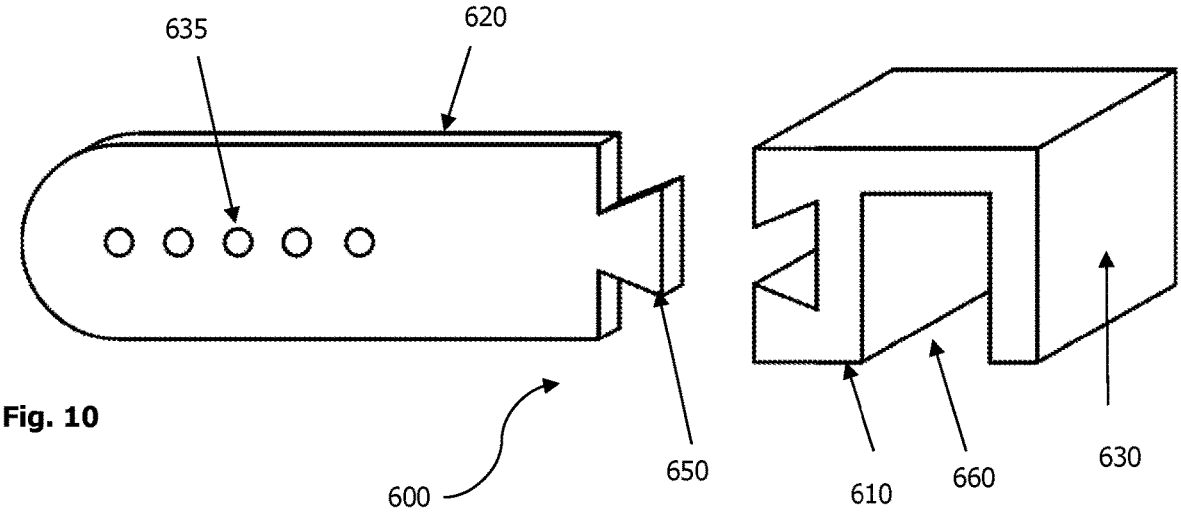
FIG. 10 is a perspective view of an alternative brace assembly for use with the formwork system and method according the present invention.

FIG. 10 depicts an alternative arrangement of the brace 600. When compared with the brace of FIGS. 3 and 5, the brace 600 includes the same first engagement formation 610 and second engagement formation 635 adapted to engage with the peg 220 or another structural element. However, the brace 600 is fabricated in a two part configuration, such that the stem 620 is separable relative to the head 630. As depicted in FIG. 10, the brace 600 includes a trapezoidal projection 650 adapted to be received in a corresponding trapezoidal channel 660. However, it will be appreciated that other arrangements may be deployed such as a ball and socket, to enable pivotal movement of the stem 620 relative to the head 630.

Figure 13:
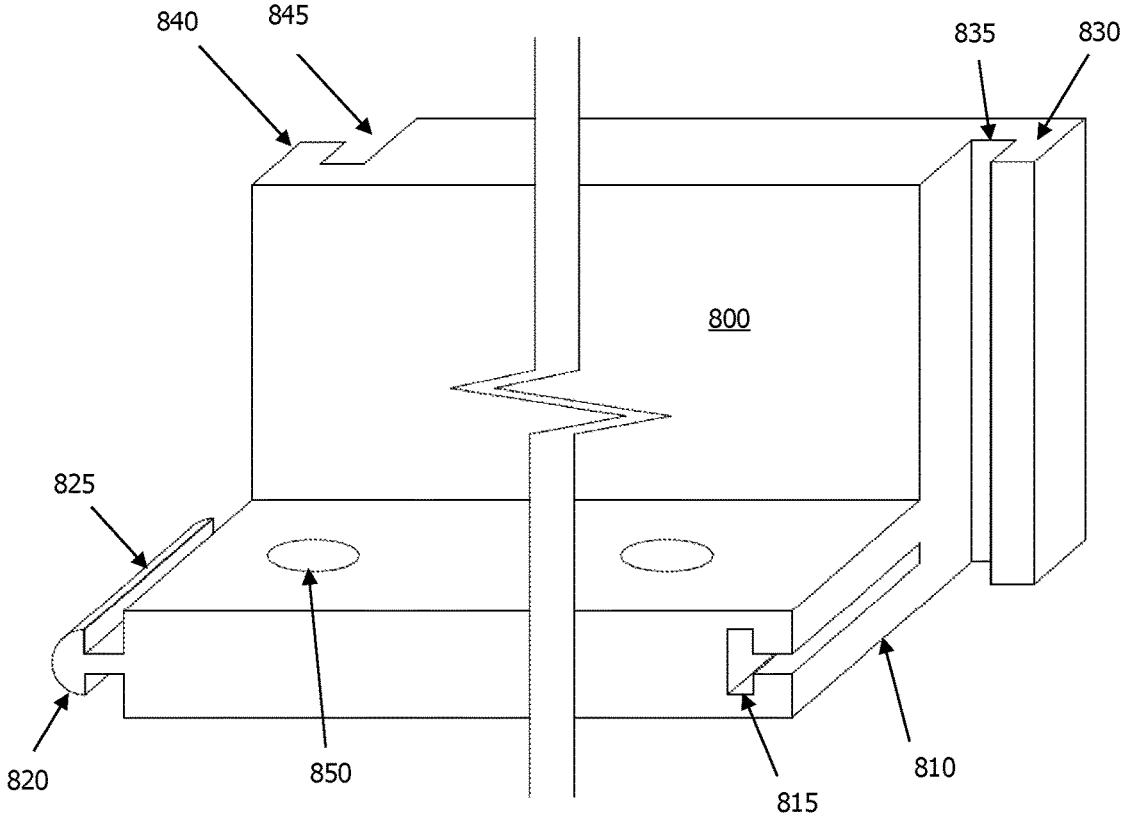
FIG. 13 is a perspective view depicting a rebate board of an embodiment of the formwork system and method.

FIG. 13 depicts a rebate board 800 of a second embodiment. The rebate board 800 operates in a similar manner to the rebate board described above, and includes a third engagement formation 810 located at one end, and a fourth engagement formation 820 located at a longitudinally opposing end. Referring to FIG. 13, the third and fourth engagement formations 820, 830 enable the rebate boards 800 to be snap connected end to end without fasteners. The third engagement formation 810 and the fourth engagement formation 820 utilise corresponding male and female portions for engagement.

In particular, in the embodiment depicted in FIG. 13, the third engagement formation 810 includes a generally horizontal T shaped channel 815 configured to receive a corresponding generally T shaped projection 825 of the fourth engagement formation.

In addition, the third engagement formation includes a generally vertically extending channel 835 and projection 830 defining a hook which is configured to engage with a complimentary vertically extending channel 845 and projection 840 defining a complimentary hook at the opposing end of the rebate board 800, so that the boards 800 can be joined end to end.

In use, the T shaped projection 825 can be slid longitudinally inside the channel 815 until the projection 830 enters the channel 845, to secure the rebate boards 800 end to end.

Alternatively, the projection 830 can be located in the channel 845, and the two adjacent rebate boards 800 hinged about a vertical axis until the T shaped projection 825 snaps into engagement with the channel 815.

Figure 14:
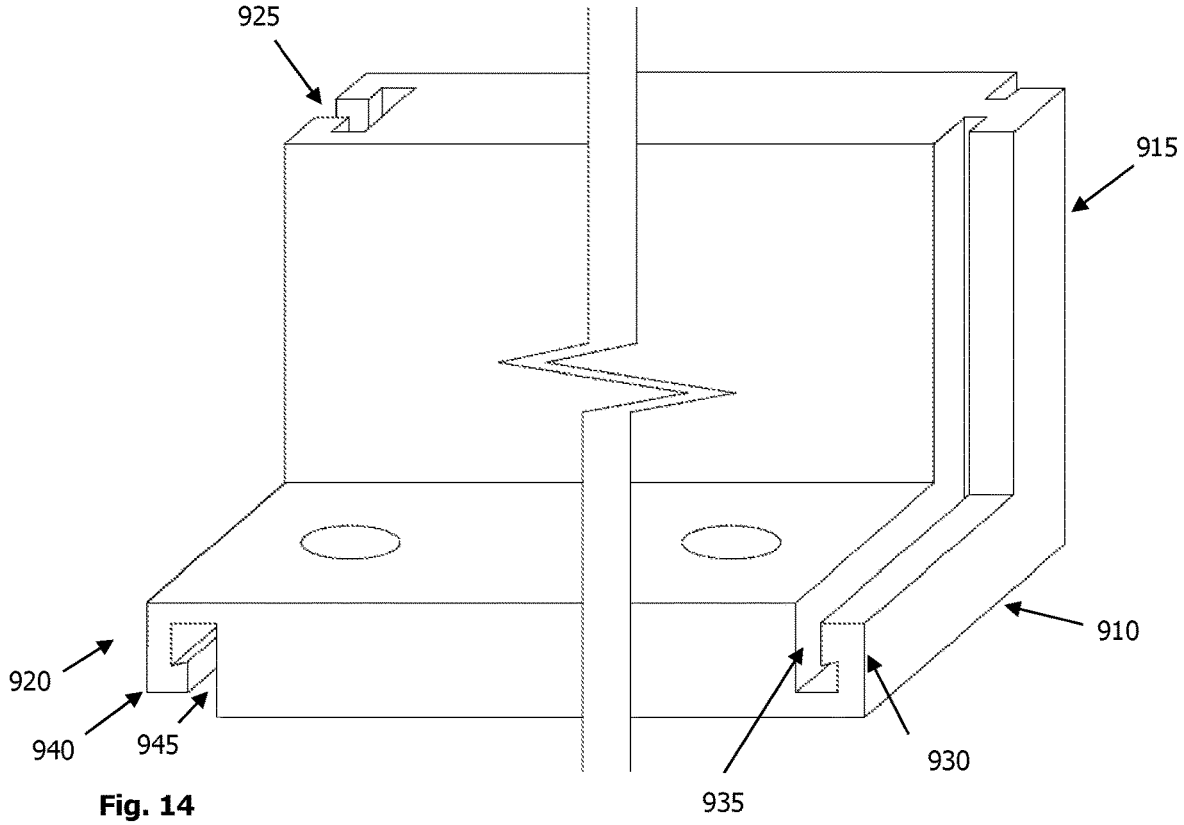
FIG. 14 is perspective view depicting a rebate board of a further embodiment of the formwork system and method.

FIG. 14 depicts a rebate board 900 of a further embodiment. The rebate board 900 operates in a similar manner to the rebate board described above, and includes a third engagement formation 910 located at one end, and a fourth engagement formation 920 located at a longitudinally opposing end. Referring to FIG. 14, the third and fourth engagement formations 920, 930 enable the rebate boards 900 to be snap connected end to end without fasteners. In the embodiment depicted in FIG. 14, the third engagement formation 910 includes a generally horizontal T shaped projection 915 configured to be received by a corresponding generally T shaped channel 925 of the fourth engagement formation.

In addition, the third engagement formation 910 includes a generally horizontally extending channel 935 and projection 930 defining a hook which is configured to engage with a complimentary horizontally extending channel 945 and projection 940 defining a complimentary hook which is located at the opposing end of the rebate board 900, so that the rebate boards 900 can be joined end to end.

During assembly, the T shaped projection 915 can be slid longitudinally inside the channel 925 until the projection 930 enters the channel 945, to secure the rebate boards 900 end to end.

The rebate boards 800, 900 include observation holes 850 which permit air to escape, and also permit the concreters to observe the level of the concrete as the slab is being poured.

The lengths of the rebate boards 800, 900 may be provided in different sizes so that the concreters can fabricate various slab lengths without requiring any cutting, or at least minimising the need for cutting.

Although two different arrangements are described above for connecting the rebate boards 800, 900, it will be appreciated that other connection systems are envisaged for joining the rebate boards 800, 900 end to end.

In each embodiment, the top braces 400, 600 are light, strong and able to be installed easily. Furthermore, the braces 400, 600 are able to withstand the forces generated during set up, concrete pouring and the initial stage of curing, before the formwork is removed.

Preferably, the bottom boards 200 and rebate boards 105 are manufactured in the same colour, while top braces 400, 600 and the H-connector 500 are fabricated in an alternative colour so as to be easily recognised on site. Preferably the colours are high visibility.

Due to the conditions encountered during set up, concrete pouring and form work removal, the components of the formwork system and method 100 must be impact resistant, and able to withstand hammer impact and other such impact.

When all four components of the formwork system and method 100 are assembled they form a removable and re-usable structure capable of forming a rebated toe at 150 mm high and an edge beam 250 mm high while using a rebate board 105 and a top brace 400, 600. Furthermore, the formwork system 100 can be used to fabricate a drop edge beam up to 1500 mm high when using the H-clips 500 and additional bottom boards 200.

The use of the system 100 will now be described. Initially, stakes or pegs 220 are driven into the earth at the desired locations around the perimeter of the intended slab. Once the pegs 220 are in position, the bottom boards 200 are secured to the pegs 220 with screws, at the desired height for the rebate toe portion of the slab. The rebate boards 105 are then secured to the bottom boards 200 with screws or other fasteners. In this position, the triangular stopper 140 (or other suitable shaped stopper) abuts against the bottom board 200.

Braces 400, 600 are then clipped to the vertical arm 110 of the rebate boards 105. The braces 400, 600 are also secured to the pegs 220 with nails or screws. Once this stage is completed, the concrete can be poured.

As the concrete level rises in the formwork, the concrete is limited by the underside of the horizontal arm 120 of the rebate boards 105. Air escapes through the holes 130, and the holes act as a visual guide to confirm that the concrete is filling the formwork as intended. The formwork is filled up until the concrete reaches the upper surface of the vertical arm 110. The concreters then vibrate and level off the concrete to the desired slab finish.

Figure 8:
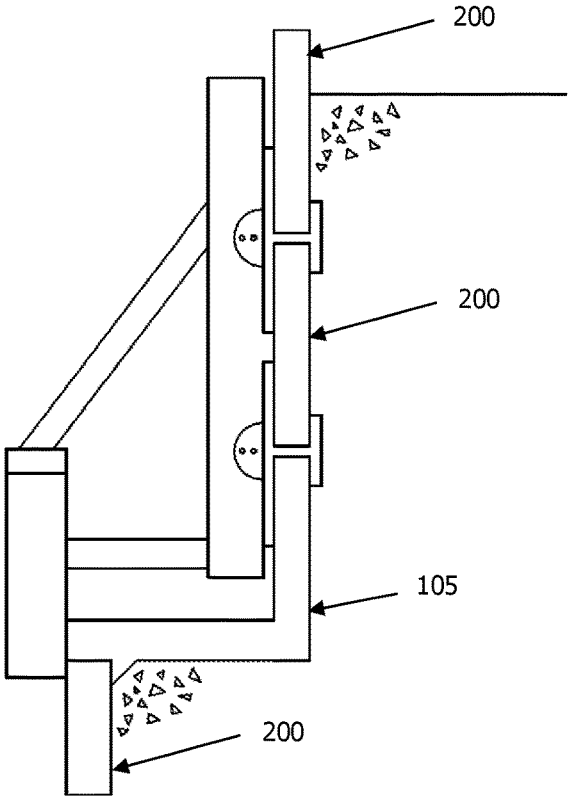
FIG. 8 is an end view depicting the formwork system and method according to the present invention used in a multiple layer form board installation.

In the scenario that a vertical slab larger than 300 mm in height is desired, such as a drop edge beam, the concreters can increase the vertical form height using the H-connectors 500 and additional boards 200, as shown in FIG. 8. Additional H-connectors 500 and boards 200 can be added to achieve the desired vertical height.

Additional bracing is also added, which may be timber bracing, or further recycled plastic bracing to counter the larger forces of a deep concrete pour.

When the formwork is removed, the rebate formed in the slab is typically 150 mm wide which is required for the outer layer of brickwork to sit on.

Advantageously, the H-connectors 500 have screwing off holes 520 to allow additional braces to support the weight of the concrete behind the drop edge wall.

Advantageously, the plastic boards 200 are lightweight, reducing risk of heavy lifting OHS hazards and over loading wear and tear on trucks.

A further advantage is that the plastic boards 200 are designed to be screwed together, which is stronger than nails. Furthermore, the screws are easier to remove, making the dismantling of formwork easier, quicker and safer.

Advantageously, the plastic top braces 400, 600 are screwed in place and act as a strong, easily removable and reusable brace that will last from job to job. Furthermore, the screws are re-usable from job to job, reducing costs and mess from discarded nails.

The plastic rebate boards 105 do not need to be hung on rebate clamps which are traditionally required for forming rebates. In contrast the plastic rebate boards 105 are screwed directly onto the top edge of the plastic bottom boards 200, which obviates the need to buy metal rebate clamps.

Advantageously, the plastic rebate boards 105 are flat and do not absorb water and concrete will not bond to them, making them easier to clean excess concrete off.

A further advantage is that the rebate boards 105 leave no open void for concrete to flow through. This leaves no wasted concrete on the ground, and reduces cost on each concrete slab poured with this system 100.

The plastic rebate boards 105 do not require any manual labour to achieve a level rebated toe for brickwork to sit on, reducing tasks of concreters on site, giving them more time to produce a quality and level concrete slab.

Once plastic boards 200 are cut down to needed sizes on site and are too small to reuse, scrap pieces can be recycled back to full length plastic boards.

Advantageously, the plastic bottom boards 200 are quicker to form up and screw in position. Furthermore, the plastic boards 200 are generally stronger than timber boards due to both the design of plastic rebate board 105, and the fact that they are screwed together.

Although the invention has been described with reference to specific examples, it will be appreciated by those skilled in the art that the invention may be embodied in many other forms.

The invention claimed is:

1. A temporary formwork system for forming concrete slabs comprising:

a rebate board having a generally L shaped profile in end view, the rebate board having a first arm and a second arm, the first and second arms being angled at about 90 degrees relative to each other, the second arm being securable to an upper portion of a formwork bottom board; and a brace having a first engagement formation configured to engage with the first arm, and a second engagement formation configured to engage with a peg or other fixed member, wherein a generally horizontal underside surface of the second arm and a contiguous generally vertical surface of the first arm are configured to retain setting concrete to define a rebate in the concrete slab wherein the second arm includes a longitudinally extended stopper configured to abut against a bottom board, and wherein the stopper has a triangular cross sectional profile having a flat surface adapted to abut against the bottom board.

2. The formwork system of claim 1, wherein the first engagement formation includes two longitudinally extending ribs defining a channel configured to abut against and engage opposing sides of the first arm.

3. The formwork system of claim 1, wherein the second engagement formation includes a plurality of holes separated from each other along a longitudinal axis of the brace.

4. The formwork system of claim 1, wherein the second arm includes a plurality of longitudinally separated air and/or inspection holes.

5. A temporary formwork system for forming concrete slabs comprising:

a rebate board having a generally L shaped profile in end view, the rebate board having a first arm and a second arm, the first and second arms being angled at about 90 degrees relative to each other, the second arm being securable to an upper portion of a formwork bottom board; and a brace having a first engagement formation configured to engage with the first arm, and a second engagement formation configured to engage with a peg or other fixed member, wherein a generally horizontal underside surface of the second arm and a contiguous generally vertical surface of the first arm are configured to retain setting concrete to define a rebate in the concrete slab, wherein the rebate board includes a third engagement formation located at one end of the rebate board and a corresponding fourth engagement formation located at an opposing end of the rebate board, the third and fourth engagement formations permitting like rebate boards to be connected end to end, wherein the second arm includes a longitudinally extended stopper configured to abut against a bottom board, and wherein the stopper has a triangular cross sectional profile having a flat surface adapted to abut against the bottom board.

6. The temporary formwork system of claim 5, further wherein the third and fourth engagement formations include male and/or female elements located on each end of the first and seconds arms of the rebate board.

7. The formwork system of claim 6, wherein the second arm includes a male formation at a first end and a corresponding female formation at an opposing second end, further wherein the first arm includes first hook portion at the first end and a corresponding second hook portion at the second end.

8. The formwork system of claim 6, wherein the first arm includes a male formation at a first end and a corresponding female formation at an opposing second end, further wherein the second arm includes a first hook portion at the first end and a corresponding second hook portion at the second end.

9. The formwork system of claim 1, further comprising a H-connector having a generally H-shaped cross-sectional profile, the H-connector defining two channels each channel configured to receiving a longitudinal edge portion of the bottom board, or the first arm.

10. The formwork system of claim 9, wherein the H-connector includes a lug having one or more securement holes for engaging with a support member.

11. The formwork system of claim 1, wherein the brace is fabricated in a two part arrangement having a stem which is separable relative to a head.

12. The formwork system of claim 11, wherein the stem incudes a trapezoidal projection adapted to be received by a trapezoidal slot formed in the head.

13. The formwork system of claim 1, wherein the rebate board and the brace are fabricated from a polymer.

14. The formwork system of claim 1, wherein the brace incudes upper and lower longitudinally extending stiffening ribs.

15. A method of setting up formwork to produce an edge rebate in a concrete slab, the method including the following steps:

securing at least one peg relative to a ground surface;

securing at least one bottom board to the peg such that an upper edge of the bottom board is located at an intended horizontal position of the desired slab rebate;

securing a longitudinally extending rebate board to the bottom board, the rebate board having a generally L shaped profile in end view, the rebate board having a first arm and a second arm, the first and second arms being angled at about 90 degrees relative to each other, the first arm being securable to the bottom board; and securing a first engagement formation of a brace to an upper portion of said second arm and securing a second engagement formation of said brace to said peg to support the rebate board in a position with one arm extending generally vertically and one arm extending generally horizontally.

16. The method of claim 15, wherein the step of securing the rebate board to the bottom board includes abutting a longitudinally extending stopper formed on an underside of the first arm against the bottom board, the stopper having a triangular cross sectional profile defining a flat surface adapted to abut against the bottom board.

* * * * *